US009885363B2

(12) United States Patent
Yazykov

(10) Patent No.: US 9,885,363 B2
(45) Date of Patent: Feb. 6, 2018

(54) CAP FOR SUBMERSIBLE PUMP

(76) Inventor: Andrey Yurievich Yazykov, Moscow (RU)

( * ) Notice: Subject to any disclaimer, the term of this patent is extended or adjusted under 35 U.S.C. 154(b) by 529 days.

(21) Appl. No.: 14/411,205

(22) PCT Filed: Aug. 30, 2012

(86) PCT No.: PCT/RU2012/000718
§ 371 (c)(1),
(2), (4) Date: Apr. 6, 2015

(87) PCT Pub. No.: WO2014/003601
PCT Pub. Date: Jan. 3, 2014

(65) Prior Publication Data

US 2015/0198171 A1 Jul. 16, 2015

(30) Foreign Application Priority Data

Jun. 28, 2012 (RU) ..... 2012127091

(51) Int. Cl.
*E21B 33/03* (2006.01)
*E21B 33/04* (2006.01)
*F04D 29/08* (2006.01)
*E21B 43/12* (2006.01)
(Continued)

(52) U.S. Cl.
CPC ..... *F04D 29/086* (2013.01); *E21B 33/03* (2013.01); *E21B 33/0407* (2013.01); *E21B 43/128* (2013.01); *F04D 13/10* (2013.01); *F04D 29/607* (2013.01)

(58) Field of Classification Search
CPC ... E21B 33/03; E03B 3/10; E03B 3/11; E03B 3/12
See application file for complete search history.

(56) References Cited

U.S. PATENT DOCUMENTS 1,509,643 A * 9/1924 Albin ..... E21B 33/03 138/90
2,390,393 A * 12/1945 Rubly ..... E21B 33/047 166/75.13
(Continued)

FOREIGN PATENT DOCUMENTS

DE 3013757 A1 * 10/1981 ..... B65D 11/04
RU 2254440 C1 6/2005
(Continued)

*Primary Examiner* — Giovanna C. Wright
(74) *Attorney, Agent, or Firm* — Nadya Reingand; Yan Hankin

(57) ABSTRACT

The cap for suspension of submersible pump with a pressure pipe and a cable with a cover with central axial hole and circular collar, with conical inner surface narrowing towards central hole, and clamping flange with central hole, sealing rubber ring of rubber cross-section installed between conical surface of collar of cover and flat side of flange. Bolts with nuts are installed in coaxial holes of cover for fixation of ring on the outer side of casing pipe of the well. Central hole of clamping flange has diameter smaller than mean diameter of rubber ring, while smaller diameter of conical surface of collar of cover is made with diameter exceeding mean diameter of rubber ring. Increased reliability and durability is provided by elimination of possibility of edge of the flange hole to cut into the rubber ring.

15 Claims, 3 Drawing Sheets

(51) Int. Cl.
*F04D 13/10* (2006.01)
*F04D 29/60* (2006.01)

(56) References Cited

U.S. PATENT DOCUMENTS

| | | | | |
|---|---|---|---|---|
| 5,943,836 | A * | 8/1999 | Kassardjian | E04C 5/161 248/523 |
| 2004/0168795 | A1 * | 9/2004 | Owens | E21B 33/03 166/75.13 |
| 2008/0245534 | A1 | 10/2008 | Purkis | |

FOREIGN PATENT DOCUMENTS

| | | | |
|---|---|---|---|
| RU | 76033 | U1 | 10/2008 |
| SU | 595485 | A1 | 10/1978 |

* cited by examiner

CAP FOR SUBMERSIBLE PUMP

REFERENCE TO RELATED APPLICATIONS

The current application claims priority to PCT application No. PCT/RU2012/000718 filed on Aug. 30, 2012, which claims priority to Russian application No. RU 2012127091 filed on Jun. 28, 2012.

FIELD OF THE INVENTION

The utility model relates to pipeline equipment for water supply and to oil and gas industry, namely, to auxiliary equipment of submersible pumps.

The cap is intended for suspension of submersible pump with pressure pipe and cable.

PRIOR ART

There is a known cap for suspension of submersible pump with a pressure pipe and a cable comprising a cover with conical surface and a central axial hole, and a clamping flange with a central axial hole installed on the well casing coaxially, a sealing rubber ring located between the conical surface of the cover and the flange, a set of coupling bolts with nuts installed in the coaxial holes of the cover and the flange (SU No 1105581).

The shortcoming of the known cap lies in the fact that the sealing rubber ring and the set of coupling bolts with nuts are located on the inner side of the casing pipe, which leads to an increase of the diameter of the casing pipe and a decrease of its effectively used through cross-section.

Also known is a cap for suspension of submersible pump with a pressure pipe and a cable comprising a cover with conical surface and a central axial hole, and a clamping flange with a central axial hole installed on the well casing coaxially, a sealing rubber ring located between the conical surface of the cover and the flange, a set of coupling bolts with nuts installed in the coaxial holes of the cover and the flange, where on the butt end of the cover facing the flange, along its circumference, there is a circular collar with inner conical surface, the vertex of its cone facing the side opposite to the flange, while the clamping flange and the sealing rubber ring are installed on the outer side of the casing pipe, where the axial holes in the cover and the flange are also made on the outer side of the casing pipe (RU No 76033, prototype).

The shortcoming of the known device is its low reliability and durability not providing repeated use of the article, which are determined by possible cutting of the edge of the flange hole into the rubber ring and the latter's being insufficiently pressed against the casing pipe.

SUMMARY OF THE INVENTIONS

The engineering target of the claimed utility model is to create an efficient cap for suspension of submersible pump with a pressure pipe and a cable. As well as to expand the range of cap models for suspension of submersible pump with a pressure pipe and a cable.

The technical result providing solution of the assigned target lies in raising the reliability and durability that provides repeated use of the article determined by eliminating the possibility of cutting of the edge of the flange hole into the rubber ring owing to guaranteed displacement of the edge of the flange hole away from the surface of contact between the flange and the rubber ring, and the latter's being pressed stronger against the casing pipe owing to making the direction of the ring's pressing against the pipe closer to being radial.

The essence of the utility model is that the cap comprises a cover with a central hole and a circular collar made in the conical inner surface form narrowing towards the central hole, as well as a clamping flange with a central hole, a rubber ring to be installed on the casing pipe between the conical surface of the cover collar and the flat side of the flange, and coupling threaded elements for fixing the rubber ring between the cover and the flange, where the central hole of the clamping flange is made with a diameter smaller than the mean diameter of the rubber ring, while the smaller diameter of the conical surface of the cover collar is made exceeding the mean diameter of the rubber ring.

In particular embodiments, the cover and the flange are made of metal, where the flange is made with a cylindrical collar on the side opposite to the side of installation of the rubber ring.

In other particular embodiments, the cover and the flange are made of plastic, where the flange is made with cylindrical and straight radial stiffening ribs on the side opposite to the side of installation of the rubber ring, and the ring is made with cylindrical and straight radial stiffening ribs on the side of installation of the rubber ring.

Preferably, the cover is provided with a collet clamp for the pressure pipe of the pump, the aforesaid collet clamp installed in the central axial hole of the cover, the cover is provided with at least one cable entry, the cover is provided with upper and lower eyebolts, where all the eyebolts are located in the same centerline plane.

BRIEF DESCRIPTION OF DRAWINGS

The FIG. 1 presents a general exploded view of a well cap for suspension of submersible pump with a pressure pipe and a cable.

DETAILED DESCRIPTION OF THE INVENTION

Preferred Embodiment

Figure 1:
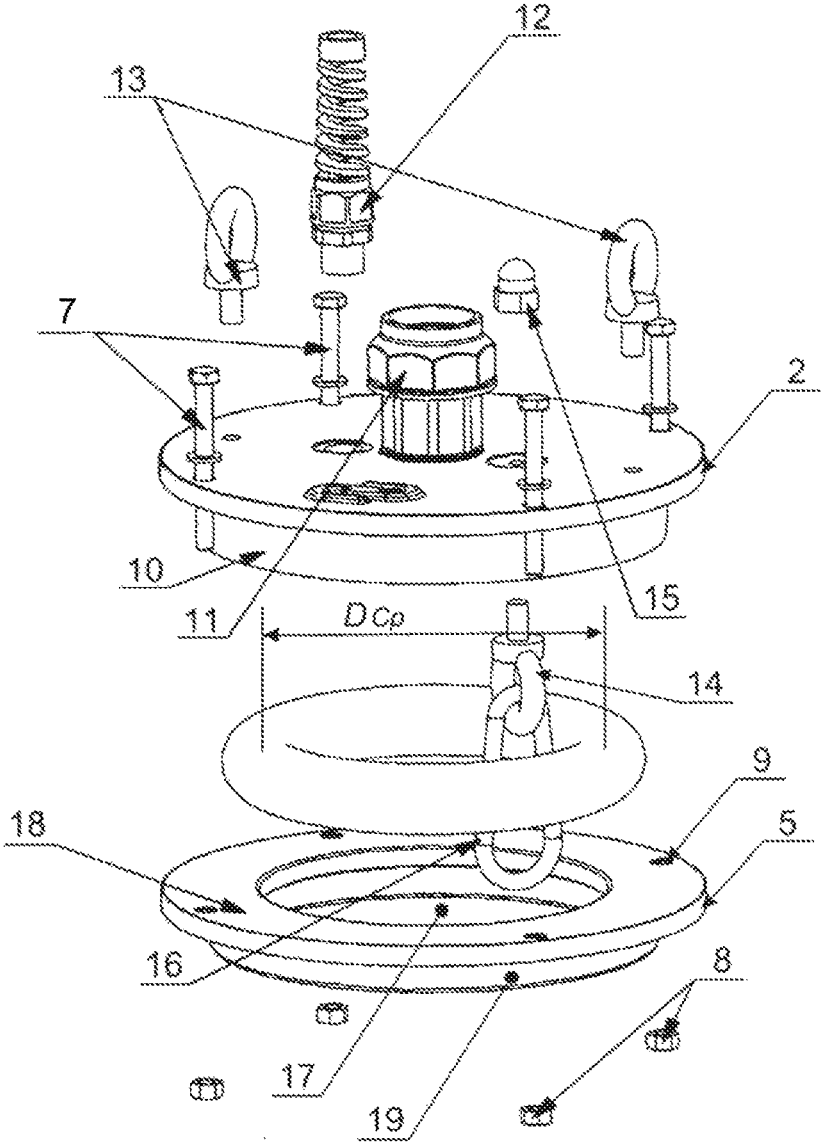
Figure 2:
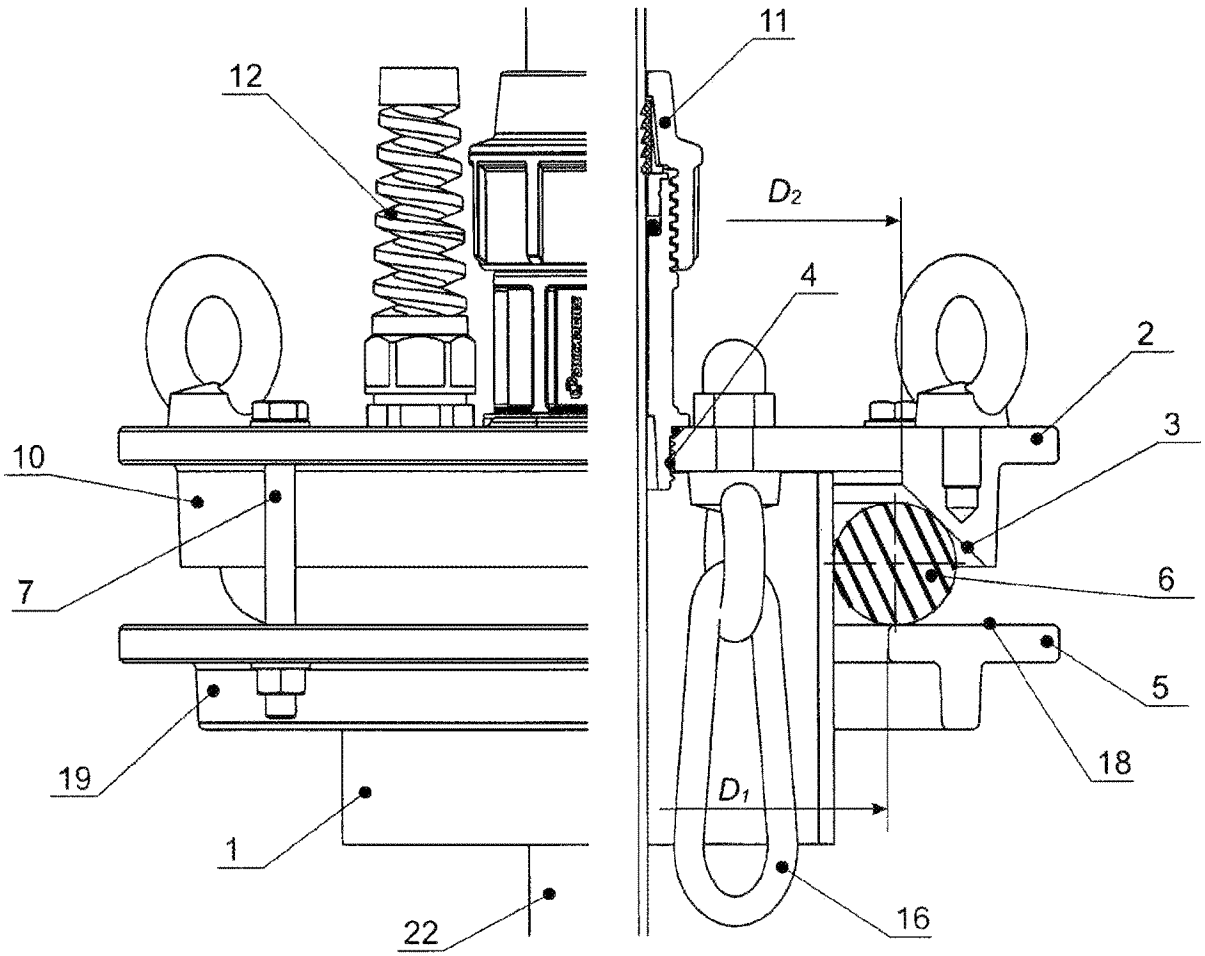
FIG. 2 presents a cutaway view of installation of the cap onto a casing pipe.
Figure 3:
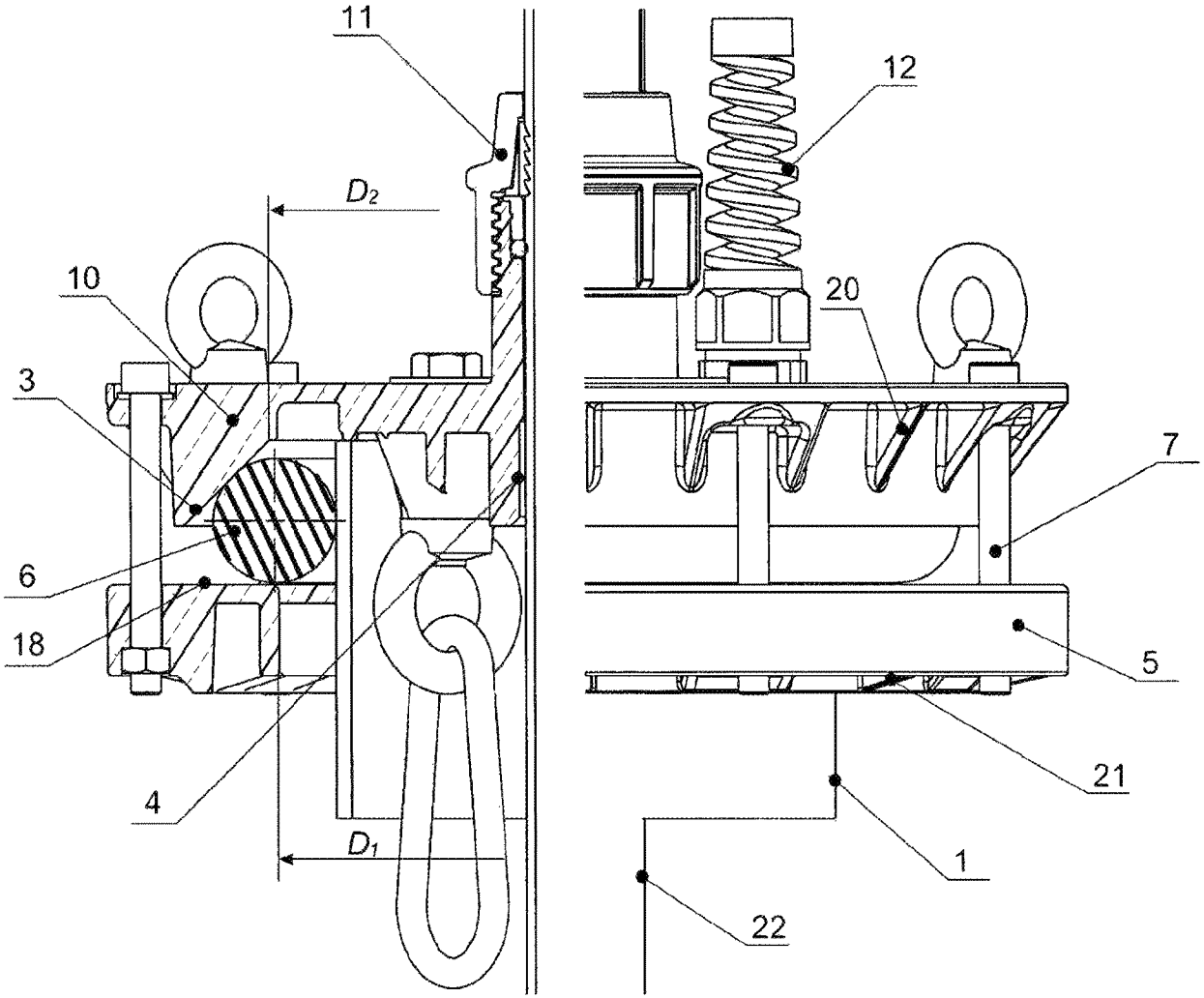
FIG. 3 presents a cutaway view of installation of a plastic cap onto a casing pipe.

The well cap for suspension of submersible pump with a pressure pipe and a cable comprises cover 2 with central axial hole 4 for passage of pressure pipe 22 and with circular collar 10 made with cylindrical outer surface and conical inner surface 3 narrowing towards central hole 4, as well as cylindrical flange 5 with central hole 17, sealing rubber ring 6 of round section to be installed onto casing pipe 1 between conical surface 3 of collar 10 of cover 2 and flat side 18 of flange 5. The coupling threaded elements—bolts 7 with nuts 8 are installed in coaxial holes 9 of cover 2 and flange 5 for fixation of rubber ring 6 with its inner diameter on outer surface of pipe 1 between cover 2 and flange 5. Central hole 17 of clamping flange 5 is made with diameter $D_1$ smaller than mean diameter $D_m$ of rubber ring 6, while smaller diameter $D_2$ of conical surface 3 of collar 10 of cover 2, exceeding mean diameter $D_m$, which is equal to the half sum of the outer and inner diameters of rubber ring 6.

Cover 2 is provided with collet clamp 11 for pressure pipe 22, the aforesaid collet clamp installed in central axial hole 4 of cover 2. Cover 2 is also provided with cable entry 12.

In particular embodiments, cover 2 and flange 5 may be made of metal (cast iron), where flange 5 is made with cylindrical collar 19 on the side opposite to the side of installation of rubber ring 6, while hole 4 is made a thread for collet clamp 11.

In other particular embodiments, cover 2 and flange 5 may be made of plastic. In this case, collet clamp 11 may be made partially (with its fixed part) integral with cover 2, where hole 4 (for pipe 22) of cover 2 is at the same time a hole of the fixed part of collet clamp 11 made integral therewith. Here, flange 5 is made of cellular design, i.e., with cylindrical and straight stiffening ribs 21 on the side opposite to the side of installation of rubber ring 6, while cover 2 is also made of cellular design, i.e., with cylindrical and straight radial stiffening ribs 20 around collar 10, on the side of installation of rubber ring 6.

In any case, cover 2 is provided with upper eyebolts 13 and lower eyebolt 14 with sealing cap locknut 15 and suspended clevis 16 for fastening of a rope for suspension of submersible pump (not shown). All eyebolts 13, 14 are located in the same centerline plane, where the vertical axis of the cover and the flange lies.

Coaxial holes 9 in cover 2 and flange 5 are made around collar 10 and, hence, on the outer side of casing pipe 1.

The well cap for suspension of submersible pump with a pressure pipe and a cable is operated as follows.

For putting in operation, prior to suspending a submersible pump with a pressure pipe and a cable, it is necessary to cut casing pipe thoroughly at right angle to its axis, which is rather difficult to do in field conditions. Then burrs are removed at the cut, casing pipe 1 is trimmed up from outside, primed and coated with corrosion-proof paint. The submersible pump is prepared for submersion according the pump manual, which includes connecting plastic pipe to the pump fitting, attaching a rope of required length to the pump housing and extending the control cable.

Next, the free part of the rope is attached to clevis 16. Clevis 16 is engaged with lower eyebolt 14, after the plastic pressure pipe has been threaded through collet clamp 11, and the cables have been threaded through cable entries 12 of cover 2. Flange 5 is put, with its flat side (surface) 18 upwards, jointly with rubber ring 6, onto casing pipe 1. The pipe is lowered, whereupon cover 2 is put onto casing pipe 1. Then, rubber ring 6 and flange 5 are raised up to the contact of ring 6 with conical surface 3 of cover 2. Bolts 7 and nuts 8 are used for drawing together flange 5 and cover 2, while contracting rubber ring 6 placed in-between.

Hermetic sealing of the pump in pipe 1 is achieved through tightening of bolts 7 contracting sealing rubber ring 6, which is located between cover 2 and clamping flange 5. Conical surface 3, when clamped with bolts 7 of cover 2 with flange 5, exercises clamping of rubber ring 6 around pipe 1. To prevent the pressure pipe of the pump from sagging, the pipe is tightening and clamped with collet clamp 11.

At the same time, assembling requires no welding operations; the pump is lowered with a winch, crane, or other hoisting mechanisms by upper eyebolts 13 mounted in cover 2.

As central hole 17 of clamping flange 5 is made with diameter $D_1$, which is guaranteed to be smaller than mean diameter $D_{cp}$ of rubber ring 6, the possibility for the edge of hole 17 of flange 5 into rubber ring 6 is eliminated owing to guaranteed displacement of the edge of hole 17 of flange 5 to pipe 1 from the surface of contact of flange 5 with rubber ring 6 and a larger area of the latter's contact with side 18 of flange 5.

As smaller diameter $D_2$ of conical surface 3 of collar 10 of cover 2 is guaranteed to be made exceeding mean diameter $D_m$ of rubber ring 6, the force pressing the latter against pipe 1 is guaranteed to increase owing to the fact that the direction of the ring's being pressed against pipe 1 is made closer to being radial and hence, the component normal to surfaces of pipe 1, of ring 6 is increased, as well as the area of contact of the same that provides hermetic sealing and reliability of the joint. At the same time increased reliability and durability are provided that is determined by elimination of the possibility for the edge of the flange to cut into the rubber ring owing to guaranteed displacement of the edge of the flange hole from the surface of contact of the flange with the rubber ring.

According to its designated purpose, this structure safely prevents the pipe and the submersible pump from penetration of surface ground waters and foreign objects, protects the pump and the pipe from unauthorized access, increases reliability and durability of the article, and provides repeated use of the rubber ring.

INDUSTRIAL APPLICATIONS

The present invention is embodied with multipurpose equipment extensively employed by the industry.

What is claimed is:

1. A cap for suspending a submersible pump comprising:

a. a cover with a central axial hole and a circular collar implemented with a conical inner surface narrowing toward the central axial hole;

b. a clamping flange with a central hole, the clamping flange having a flat top surface;

c. a rubber ring, having a mean diameter, to be installed onto a casing pipe between the conical inner surface of the circular collar of the cover and the flat top surface of the clamping flange; and d. coupling thread elements for fixation of the rubber ring between the cover and the clamping flange, wherein the central hole of the clamping flange is made with a diameter smaller than the mean diameter of the rubber ring, and a smallest diameter of the conical inner surface of the circular collar of the cover exceeds the mean diameter of the rubber ring.

2. The cap for suspending the submersible pump of claim 1, wherein:

the cover has a collet clamp installed in the central axial hole for a pressure pipe.

3. The cap for suspending the submersible pump of claim 1, wherein:

the cover having at least one cable entry.

4. The cap for suspending the submersible pump of claim 1, wherein:

a. the cover having upper eyebolts and lower eyebolts; and b. the upper and the lower eyebolts are located along a centerline plane.

5. The cap for suspending the submersible pump of claim 1, wherein:

a. the cover and the clamping flange are made of metal; and b. the clamping flange is made with a cylindrical collar on the opposite side of where the rubber ring is installed.

6. The cap for suspending the submersible pump of claim 1, wherein:

a. the clamping flange is made of plastic; and b. the clamping flange is made with cylindrical and straight radial stiffening ribs on a side opposing the flat top surface.

7. A cap for suspending a submersible pump comprising:

a cover with a central axial hole and a circular collar having a conical inner surface narrowing toward the central axial hole, the circular collar having a first external surface;

a clamping flange with a central hole, the clamping flange having a flat top surface;

a rubber ring, having a mean diameter, to be installed onto a casing pipe between the conical inner surface of the circular collar of the cover and the flat top surface of the clamping flange;

coupling thread elements for fixation of the rubber ring between the cover and the clamping flange; and a collet clamp installed in the central axial hole for a pressure pipe, wherein the central hole of the clamping flange is made with a diameter smaller than the mean diameter of the rubber ring, a smallest diameter of the conical inner surface of the circular collar of the cover exceeds the mean diameter of the rubber ring, the clamping flange having a first plurality of cylindrical and radial stiffening ribs on a side opposite to the flat top surface, and the cover having a second plurality of cylindrical and radial stiffening ribs on the first external surface.

8. The cap for suspending the submersible pump according to claim 7, wherein the cover and the clamping flange are made of metal.

9. The cap for suspending the submersible pump according to claim 8, wherein the cover having at least one cable entry.

10. The cap for suspending the submersible pump according to claim 8, wherein the cover having upper eyebolts and lower eyebolts.

11. The cap for suspending the submersible pump according to claim 7, wherein the cover and the clamping flange are made of plastic.

12. The cap for suspending the submersible pump according to claim 11, wherein the cover having at least one cable entry.

13. The cap for suspending the submersible pump according to claim 11, wherein the cover having upper eyebolts and lower eyebolts.

14. The cap for suspending the submersible pump according to claim 7, wherein the cover having at least one cable entry.

15. The cap for suspending the submersible pump according to claim 7, wherein the cover having upper eyebolts and lower eyebolts.

* * * * *